US005977843A

United States Patent [19]

Watanabe

[11] Patent Number: 5,977,843

[45] Date of Patent: Nov. 2, 1999

[54] HIGH FREQUENCY POWER DIVIDER AND HIGH FREQUENCY POWER COMBINER

[75] Inventor: Shigeru Watanabe, Tokyo, Japan

[73] Assignee: Kabushiki Kaisha Toshiba, Kawasaki, Japan

[21] Appl. No.: 09/053,639

[22] Filed: Apr. 2, 1998

[30] Foreign Application Priority Data

Apr. 8, 1997 [JP] Japan ..... 9-088988

[51] Int. Cl.[6] ..... H01P 5/12

[52] U.S. Cl. ..... 333/127; 333/128

[58] Field of Search ..... 333/124, 125, 333/127, 128, 136

[56] References Cited

U.S. PATENT DOCUMENTS

| | | | |
|---|---|---|---|
| 4,547,745 | 10/1985 | Freitag et al. | 333/128 X |
| 4,901,042 | 2/1990 | Terakawa et al. | 333/127 |
| 5,126,704 | 6/1992 | Dittmer et al. | 333/128 X |

FOREIGN PATENT DOCUMENTS 9-18209 1/1997 Japan .

OTHER PUBLICATIONS

Webb, R.C., Power Divider/Combiners:Small Size, Big Specs, Microwaves, pp. 67–74, vol. 20, No. 12, Nov. 1981.

*Primary Examiner*—Paul Gensler
*Attorney, Agent, or Firm*—Oblon, Spivak, McClelland, Maier & Neustadt, P.C.

[57] ABSTRACT

A circuit for combining and dividing a high frequency power including a first transmission line connected between a first port and a third port, a second transmission line connected between a second port and the third port, and a circuit section having one end connected between the first port and the first transmission line and the other end connected between the second port and the second transmission line, the circuit section including a resistor and at least one capacitor connected in series.

14 Claims, 3 Drawing Sheets

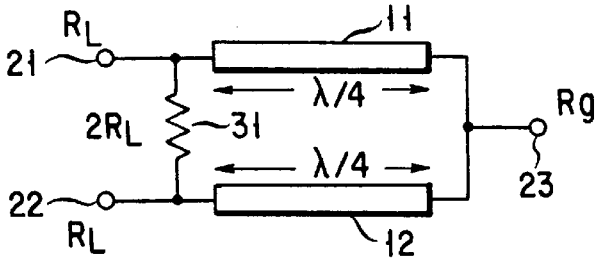
FIG. 1
*PRIOR ART*
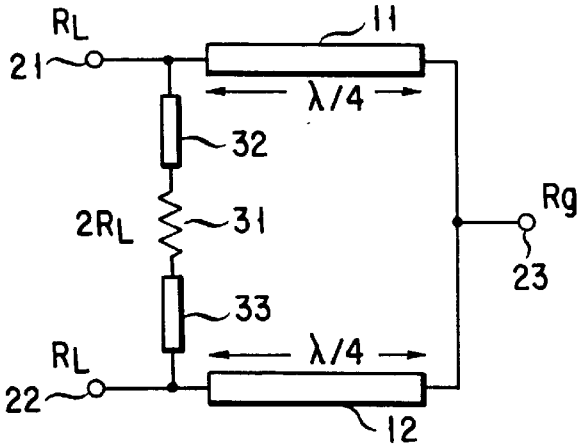
FIG. 2
*PRIOR ART*
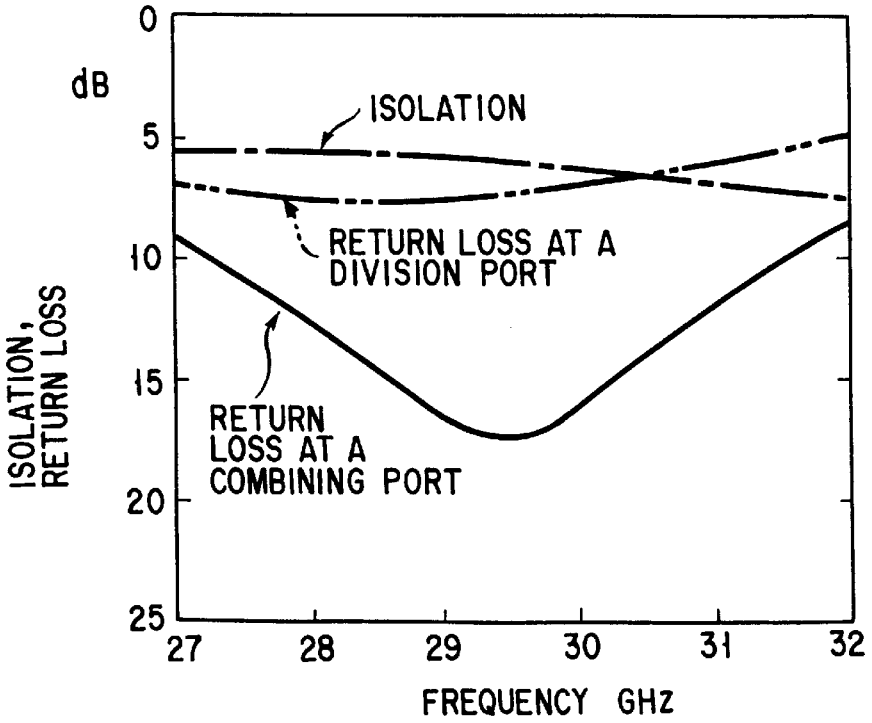
*PRIOR ART* FIG. 3

HIGH FREQUENCY POWER DIVIDER AND HIGH FREQUENCY POWER COMBINER

BACKGROUND OF THE INVENTION

The present invention relates generally to a circuit for combining and dividing high frequency power, and more particularly to a microwave power combiner/divider for use in a microwave communication apparatus, etc.

There is known a power combiner/divider for use in a microwave band, which comprises as a basic structure a so-called Wilkinson type power combiner/divider circuit. This circuit is advantageous in that the circuit configuration is simple and it has an impedance conversion function. By virtue of the advantage, this power combiner/divider circuit is widely used, for example, as an output matching circuit in a high output power amplifier.

FIG. 1 shows an equivalent circuit of a conventional Wilkinson type power combiner/divider.

As is shown in FIG. 1, one end of a first transmission line 11 is used as a first signal port (division port) 21, and one end of a second transmission line 12 is used as a second signal port (division port) 22.

The other end of the first transmission line 11 and the other end of the second transmission line 12 are connected at a third signal port (combining port) 23. The first signal port 21 and second signal port 22 are connected via a resistor (isolation resistor) 31.

The length of each of the first and second transmission lines 11 and 12 is set at about ¼ of the wavelength of the input signal. The characteristic impedance of each transmission line 11, 12 and the value of the resistor 31 are determined by the impedances of the first to third signal ports 21, 22 and 23.

It is known that the characteristic impedance should ideally be set at $(2R_L \cdot R_g)^{1/2}$ and the resistance at $2R_L$ in the case of a circuit wherein the impedances of the first and second signal ports 21 and 22 (division ports) and the impedance of the third port 23 (combining port) are set at $R_L$ and $R_g$ respectively and a signal input from the third signal port 23 is divided into equal-level signals to the first and second signal ports 21 and 22.

When the circuit shown in FIG. 1 is actually used, power amplifier circuits, for example, are connected to the first and second signal ports 21 and 22. As a matter of course, when such amplifier circuits are connected, the first signal port 21 and second signal port 22 need to be disposed away from each other at a predetermined distance.

Although the resistor connected between the first signal port 21 and second signal port 22 should ideally be a lumped-parameter device, as mentioned above, the resistor is influenced by a parasitic element occurring due to the increased distance between the first and second signal ports 21 and 22.

FIG. 2 shows an equivalent circuit in a case where there is a distance between the first and second signal ports 21 and 22.

In the circuit diagram, the influence of the parasitic element at the resistor can be expressed by transmission lines 32 and 33 connected to the resistor 31. Suppose that in the equivalent circuit of the power combiner/divider circuit, as shown in FIG. 2, microstrip lines are provided on a GaAs semi-insulative substrate with a thickness of 30 μm, and the distance between the first signal port (division port) 21 and second signal port (division port) 22 is 530 μm and the width of each microstrip line (i.e. first and second transmission lines 11 and 12) is 150 μm. In this case, two wiring elements having a length of 190 μm are needed to connect the resistor 31. FIG. 3 shows a simulation result, in which a parasitic effect in this case is taken into account.

The abscissa in FIG. 3 indicates the frequency (GHz) and the ordinate indicates the isolation and return loss (dB). The center frequency is 29.5 GHz, the impedance of each of the division ports (first and second signal ports) and that of the combining port (third signal port) are respectively 3Ω and 50Ω, and the isolation resistance of 6Ω is connected to the microstrip lines with a width of 20 μm.

As is understood in FIG. 3, the return loss and isolation of the division port, which can be obtained, are at most about 7 dB at the center frequency.

As has been described above, the effect of the resistor itself is considerably deteriorated by the addition of the parasitic element to the resistor portion, and the isolation between the first signal port 21 and second signal port 22 is degraded.

BRIEF SUMMARY OF THE INVENTION

The present invention has been made in consideration of the above problems, and its object is to provide a high frequency power divider and a high frequency power combiner with high isolation characteristics, wherein deterioration in isolation characteristics due to an increased distance between first and second signal ports is prevented.

In order to achieve the object, according to a first aspect of the invention, there is provided a high frequency power combiner comprising:

- a first port to which a first high frequency signal is input;
- a second port to which a second high frequency signal is input;
- a third port for outputting a third high frequency signal obtained by combining the first high frequency signal and the second high frequency signal;
- a first transmission line having one end connected to the first port and the other end connected to the third port;
- a second transmission line having one end connected to the second port and the other end connected to the third port; and
- a circuit having one end connected between the first port and the first transmission line and the other end connected between the second port and the second transmission line, the circuit including a resistor and at least one capacitor connected in series.

According to a second aspect of the invention, there is provided a high frequency power divider comprising:

- a first port to which a first high frequency signal is input;
- a first transmission line having one end connected to the first port;
- a second transmission line having one end connected to the first port;
- a second port for outputting a second high frequency signal which is a division of the first frequency signal;
- a third port for outputting a third high frequency signal which is a division of the second high frequency signal; and
- a circuit having one end connected between the second port and the second transmission line and having the other end connected between the third port and the second transmission line, the circuit including a resistor and at least one capacitor connected in series.

According to a third aspect of the invention, there is provided a circuit for combining and dividing a high frequency power comprising:

a first transmission line connected between a first port and a third port;

a second transmission line connected between a second port and the third port; and a circuit section having one end connected between the first port and the first transmission line and the other end connected between the second port and the second transmission line, the circuit section including a resistor and at least one capacitor connected in series.

According to fourth aspect of the invention, there is provided the circuit according to the third aspect, wherein the circuit section comprises:

a first capacitor having one end connected between the first port and the first transmission line;

a resistor having one end connected to the other end of the first capacitor; and a second capacitor having one end connected to the other end of the resistor and having the other end connected between the second port and the second transmission line.

According to a fifth aspect of the invention, there is provided the circuit according to the third aspect, wherein the circuit section comprises:

a capacitor having one end connected between the first port and the first transmission line; and a resistor having one end connected to the other end of the capacitor and having the other end connected between the second port and the second transmission line.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 1 shows an equivalent circuit of a conventional Wilkinson type power combiner/divider circuit;

FIG. 2 shows an equivalent circuit wherein there is a distance between a first signal port and a second signal port;

FIG. 3 shows characteristics of the conventional power combiner/divider circuit;

DETAILED DESCRIPTION OF THE INVENTION

Figure 4:
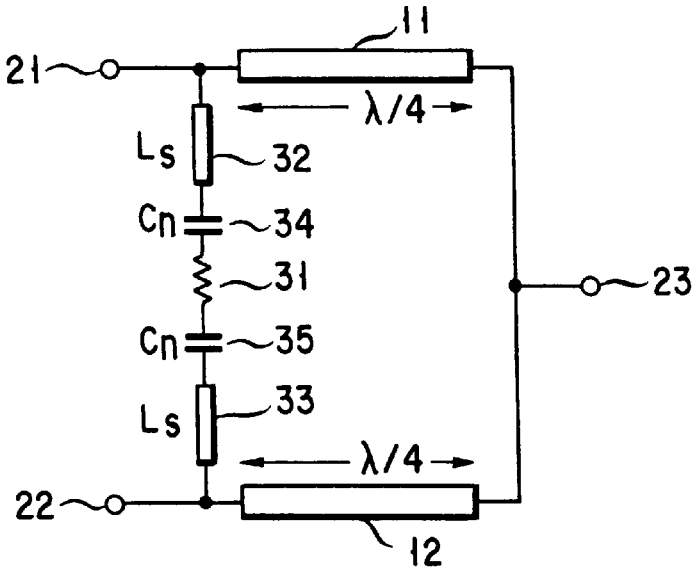
FIG. 4 shows a microwave power combiner/divider circuit according to a first embodiment of the present invention.

FIG. 4 shows a microwave power combiner/divider circuit according to a first embodiment of the present invention.

As is shown in FIG. 4, one end of a first transmission line 11 is used as a first signal port (division port) 21 and one end of a second transmission line 12 is used as a second signal port (division port) 22.

The other end of the first transmission line 11 and the other end of the second transmission line 12 are connected at a third signal port (combining port) 23.

A first capacitor 34, a resistor (isolation resistor) 31 and a second capacitor 35 are connected in series between the first signal port 21 and the second signal port 22.

The length of each of the first and second transmission lines 11 and 12 is set at about ¼ of the wavelength of the input signal. It is to be noted that the length of each of the first and second transmission lines 11 and 12 can be set in a range of from $\lambda/8$ to $3\lambda/8$. In such a case, effects of the present invention can also be obtained.

The characteristic impedance of each transmission line 11, 12 and the value of the resistor 31 are determined by the impedances of the first to third signal ports 21, 22 and 23.

In FIG. 4, parasitic elements between the first signal port 21 and second signal port 22 are expressed by transmission lines 32 and 33.

Figure 5:
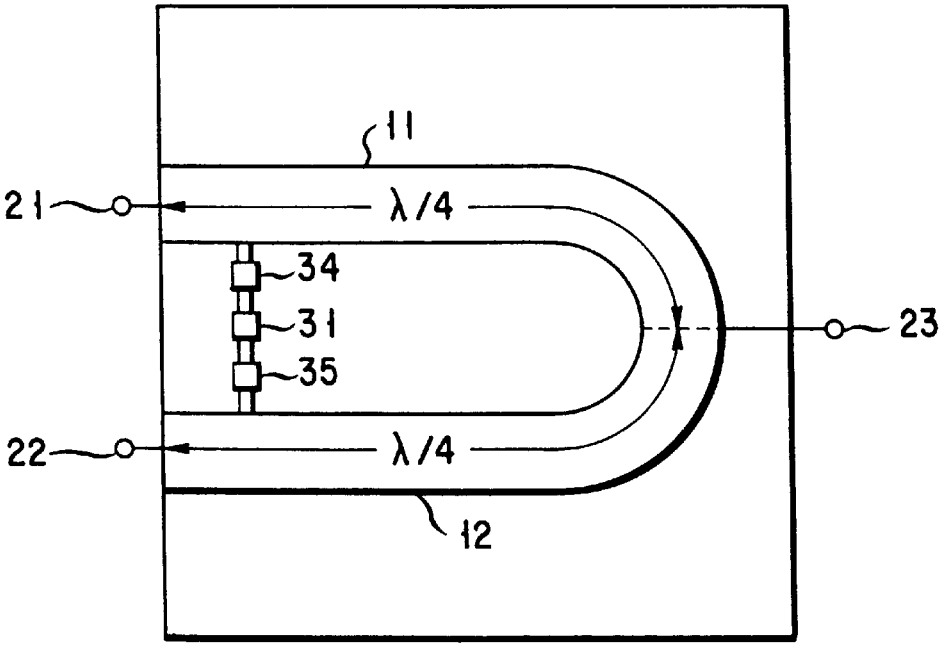
FIG. 5 shows the microwave power combiner/divider circuit according to the first embodiment, which is constructed as a monolithic integrated circuit.

FIG. 5 is a plan view showing the circuit of FIG. 4 which is constructed as a monolithic integrated circuit.

A U-shaped microstrip line is formed on a GaAs semi-insulative substrate, and the halves of the U-shaped microstrip line are used as the transmission lines 11 and 12, respectively.

Upper ends (left-hand ends in FIG. 5) of the U-shape are used as the first signal port (division port) 21 and second signal port (division port) 22 respectively, and a lower end (a right-hand end in FIG. 5) of the U-shape is used as the third signal port (combining port) 23.

The length of each of the transmission lines 11 and 12 is about ¼ of the wavelength of the signal. A circuit, wherein a first capacitor 34, a resistor 31 and a second capacitor 35 are connected in series in the named order, is provided between the first signal port 21 and second signal port 22.

In the case of a microstrip line having a length 1 sufficiently small relative to the wavelength, if a propagation constant is $\gamma$, an effective inductance Ls at the time when $\gamma \cdot << 1$ is expressed by $$L_s = Zo(\epsilon_{eff})^{1/2}\ 1 \cdot Co^{-1} \tag{1}$$

where Zo and $\epsilon_{eff}$ are the characteristic impedance and equivalent dielectric constant of the microstrip line, and Co is the velocity of light.

If in the conventional Wilkinson type power combiner/divider the high frequency characteristics such as isolation characteristics deteriorate due to parasitic inductance Ls, the deterioration is canceled by connecting a capacitor Cn, represented by the following equation, to the resistor in series:

$$C_n = \omega^{-2} Ls^{-1} \tag{2}$$

where $\omega$ is the angular frequency.

As regards the above structure, suppose, as in the above-described prior art, that the thickness of the GaAs substrate is 30 $\mu$m, the distance between the division ports (first signal port 21 and second signal port 22) is 530 $\mu$m and the width of each microstrip line (i.e. first and second transmission lines 11 and 12) is 150 $\mu$m. In this case, if the impedance of each of the division ports (first and second signal ports) and that of the combining port (third signal port) are respectively 3Ω and 50Ω and the isolation resistance of 6Ω (resistor 31) is connected to the microstrip lines with a width of 20 μm and 190 μm, the characteristic impedance and equivalent dielectric constant of the transmission lines 32 and 33 are, respectively, Zo=50Ω and $\epsilon_{eff}$=8.9.

From equation (1), the parasitic inductance when l=190 μm is given by $L_s$=95.5 pH. From equation (2), the capacitance of each of the first and second capacitors needs to be 0.3 pF.

Figure 6:
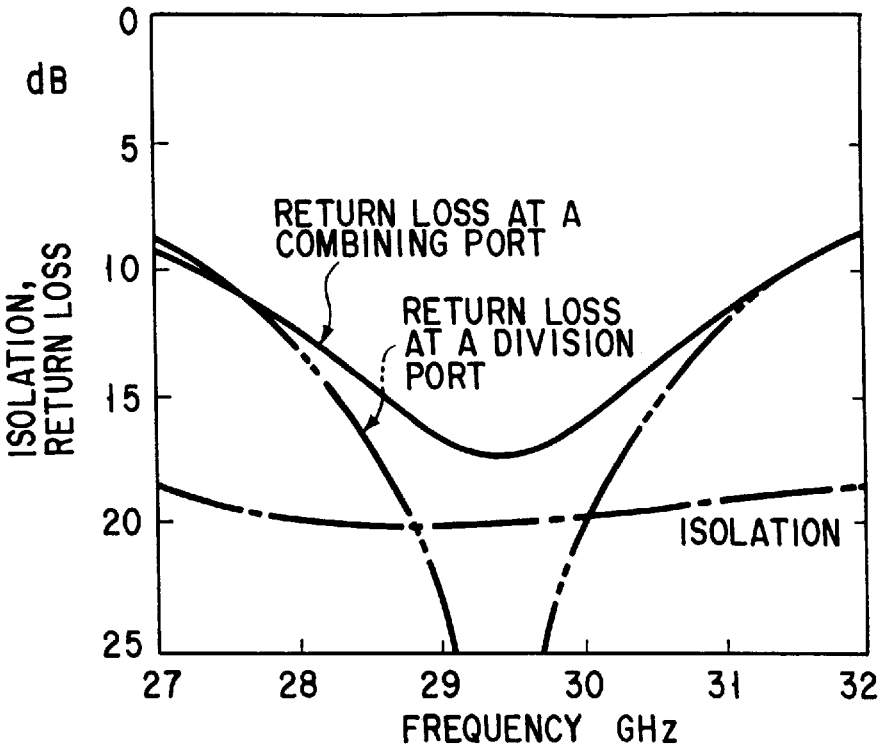
FIG. 6 shows characteristics of the microwave power combiner/divider according to the first embodiment.

FIG. 6 shows a simulation result obtained when the above-mentioned first and second capacitors 34 and 35 are connected to the resistor 31. If the result of FIG. 6 is compared to the result of the prior art shown in FIG. 3, it is understood that the isolation characteristics and return loss are improved by 20 dB or more and 25 dB or more, respectively, at the center frequency of 29.5 GHz.

According to the above structure, the first and second capacitors 34 and 35 cancel the inductive properties of the transmission lines 32 and 33 or the inductive parasitic elements which occur due to an increase in distance between the first signal port 21 and second signal port 22. Thus, excellent isolation characteristics can be attained.

Ideal high frequency characteristics of the microwave band power combiner/divider circuit can be obtained by designing the circuit on the basis of the distance between the first signal port 21 and second signal port 22, using equations (1) and (2).

Figure 7:
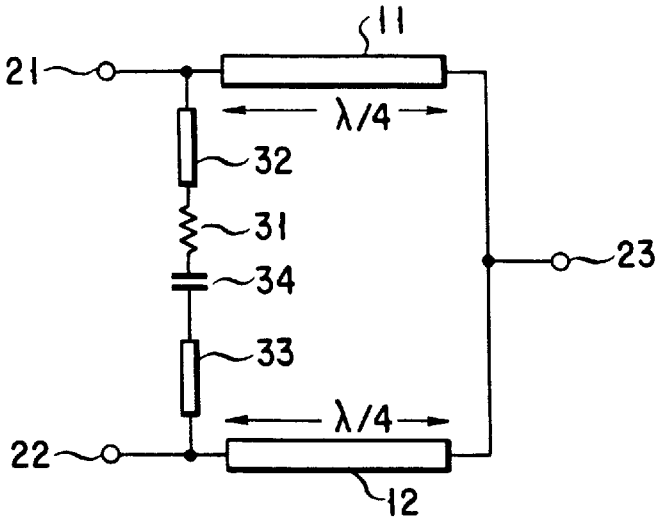
FIG. 7 shows a microwave power combiner/divider circuit according to a second embodiment of the present invention.

FIG. 7 shows a power divider/combiner circuit according to a second embodiment of the invention. The elements common to those shown in FIG. 4 are denoted by like reference numerals, and a description thereof is omitted.

As is shown in FIG. 7, a capacitor 34 and a resistor 31 are connected in series between the first signal port 21 and second signal port 22. Even if the number of capacitors is reduced to one, as in this embodiment, the advantage of the invention is obtained.

Even in the above case wherein the number of capacitors is one, the inductive properties of the parasitic elements 32 and 33 caused by the increase in distance between the first and second signal ports 21 and 22 are canceled by the series-connection of the capacitor 34. Therefore, excellent isolation characteristics can be obtained. In this case, the capacitance is about half the capacitance obtained when two capacitors are provided.

The microwave power combiner/divider of this embodiment is particularly effective and easily achieved when it is constituted by a monolithic microwave integrated circuit formed on a semi-insulative semiconductor substrate of, e.g. GaAs.

As has been described above, the present invention can provide a microwave power combiner/divider circuit having excellent isolation characteristics.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. A high frequency power combiner comprising:

a first port to which a first signal having a high frequency is input;

a second port to which a second signal having a high frequency is input;

a third port for outputting a third signal being obtained by combining the first signal and the second signal;

a first transmission line having one end connected to the first port and the other end connected to the third port;

a second transmission line having one end connected to the second port and the other end connected to the third port;

a first capacitor having one end connected between the first port and the first transmission line;

a resistor having one end connected to the other end of the first capacitor; and a second capacitor having one end connected to the other end of the resistor and having the other end connected between the second port and the second transmission line.

2. The high frequency power combiner according to claim 1, wherein capacitance of the first capacitor is equal to that of the second capacitor.

3. The high frequency power combiner according to claim 1, wherein the first transmission line, second transmission line, first capacitor, resistor and second capacitor are constructed as a monolithic integrated circuit.

4. The high frequency power combiner according to claim 1, wherein a capacitance $C_n$ of the first and second capacitors is determined by the following equation:

$$C_n = w^{-2} L_s^{-1},$$

where w is an angular frequency of the first signal and $L_s$ is a parasitic inductance between the first and second ports.

5. The high frequency power combiner according to claim 1, wherein a length of the first transmission line is in a range of from λ/8 to 3λ/8, where λ is a wavelength of the first signal.

6. The high frequency power combiner according to claim 1, wherein a length of the second transmission line is in a range of from λ/8 to 3λ/8, where λ is a wavelength of the second signal.

7. A high frequency power divider comprising:

a first port to which a first signal having a high frequency is input;

a first transmission line having one end connected to the first port;

a second transmission line having one end connected to the first port;

a second port for outputting a second signal being divided from the first signal input from the first port;

a third port for outputting a third signal being divided from the first signal input from the first port;

a first capacitor having one end connected between the second port and the first transmission line;

a resistor having one end connected to the other end of the first capacitor; and a second capacitor having one end connected to the other end of the resistor and having the other end connected between the third port and the second transmission line.

8. The high frequency power divider according to claim 7, wherein the first transmission line, second transmission line, first capacitor, resistor and second capacitor are constructed as a monolithic integrated circuit.

9. The high frequency power divider according to claim 7, wherein a capacitance $C_n$ of the first and second capacitors is determined by the following equation:

$$C_n = w^{-2} L_s^{-1},$$

where w is an angular frequency of the first signal and $L_s$ is a parasitic inductance between the first and second ports.

10. The high frequency power divider according to claim 7, wherein a length of each of the first and second transmission lines is in a range of from $\lambda/8$ to $3\lambda/8$, where $\lambda$ is the wavelength of the first signal.

11. A circuit for combining and dividing a high frequency power comprising:

a first transmission line connected between a first port and a third port;

a second transmission line connected between a second port and the third port;

a first capacitor having one end connected between the first port and the first transmission line;

a resistor having one end connected to the other end of the first capacitor; and a second capacitor having one end connected to the other end of the resistor and having the other end connected between the second port and the second transmission line.

12. The circuit according to claim 11, wherein a capacitance $C_n$ of the first capacitor is equal to that of the second capacitor.

13. The circuit according to claim 11, wherein the first transmission line, second transmission line, first capacitor, resistor and second capacitor are constructed as a monolithic integrated circuit.

14. The circuit according to claim 11, wherein a capacitance $C_n$ of the first and second capacitors is determined by the following equation:

$$C_n = w^{-2} L_s^{-1},$$

where w is an angular frequency of the first signal and $L_s$ is a parasitic inductance between the first and second ports.

* * * * *